US011318518B2

(12) United States Patent
Naroska

(10) Patent No.: US 11,318,518 B2
(45) Date of Patent: May 3, 2022

(54) DEEP DRAWING TOOL AND DEEP DRAWING PROCESS FOR DEEP DRAWING BLANKS

(71) Applicant: Rainer Naroska Engineering GmbH, Lemgo (DE)

(72) Inventor: Marcus Naroska, Bad Salzuflen (DE)

(73) Assignee: Rainer Naroska Engineering GmbH, Lemgo (DE)

( * ) Notice: Subject to any disclaimer, the term of this patent is extended or adjusted under 35 U.S.C. 154(b) by 871 days.

(21) Appl. No.: 15/751,346

(22) PCT Filed: Aug. 5, 2016

(86) PCT No.: PCT/EP2016/001349
§ 371 (c)(1),
(2) Date: Feb. 8, 2018

(87) PCT Pub. No.: WO2017/025181
PCT Pub. Date: Feb. 16, 2017

(65) Prior Publication Data

US 2020/0197996 A1 Jun. 25, 2020

(30) Foreign Application Priority Data

Aug. 12, 2015 (DE) ..... 102015113267.2

(51) Int. Cl.
*B21D 22/22* (2006.01)
*B21D 24/12* (2006.01)

(52) U.S. Cl.
CPC ..... *B21D 22/22* (2013.01); *B21D 24/12* (2013.01)

(58) Field of Classification Search
CPC ..... B21D 22/22; B21D 22/21; B21D 22/00; B21D 22/20; B21D 24/00; B21D 24/02; B21D 24/04; B21D 24/08; B21D 24/10; B21D 24/14; B21D 22/206; B23Q 5/02; B23Q 5/027; B23Q 5/033; B23Q 5/06; B30B 15/148; B30B 15/166; B30B 15/26
See application file for complete search history.

(56) References Cited

U.S. PATENT DOCUMENTS 924,672 A * 6/1909 Klocke ..... B21D 22/22 72/350
3,267,715 A * 8/1966 Williamson ..... B21D 24/02 72/351

(Continued)

FOREIGN PATENT DOCUMENTS

CN 1434282 A 8/2003
EP 2125264 B1 7/2010
GB 1481202 A * 7/1977 ..... B21D 24/08

*Primary Examiner* — Gregory D Swiatocha
*Assistant Examiner* — Bobby Yeonjin Kim
(74) *Attorney, Agent, or Firm* — Richard M. Goldberg

(57) ABSTRACT

A deep-drawing tool for deep drawing blanks which are punched out of sheet material that is painted or coated with film material, in order to obtain flangeless molded blanks, includes a drawing bell, a drawing core, a blank holder, a force transmission device, a drawing cushion for applying a spring force to the blank holder by the force transmission device, and a drive which, after the drawing bell reaches a predetermined position in downward movement thereof, drives the force transmission device to perform a movement which precedes movement of the drawing bell.

10 Claims, 9 Drawing Sheets

(56) References Cited

U.S. PATENT DOCUMENTS

| | | | | |
|---|---|---|---|---|
| 3,373,596 | A * | 3/1968 | Moeller | B30B 15/0029 72/446 |
| 4,248,545 | A * | 2/1981 | Andersen | B21D 24/04 403/223 |
| 2009/0126453 | A1 | 5/2009 | Suzuki | |
| 2010/0139357 | A1* | 6/2010 | Haar | B21D 24/14 72/347 |
| 2010/0275670 | A1* | 11/2010 | Nagai | B21D 37/08 72/345 |
| 2011/0036140 | A1 | 2/2011 | Miyasaka et al. | |
| 2013/0333437 | A1* | 12/2013 | Schollhammer | B30B 1/14 72/347 |

* cited by examiner

DEEP DRAWING TOOL AND DEEP DRAWING PROCESS FOR DEEP DRAWING BLANKS

BACKGROUND OF THE INVENTION

This invention relates to a deep-drawing tool for deep-drawing blanks which are punched out of sheet metal that is painted or coated with film material, in order to obtain flangeless moulded blanks, and to a corresponding method.

Deep-drawing tools of this type are used to produce container lids in particular. The blanks are punched from metal sheets and are deep drawn in a deep-drawing tool to obtain an approximately pot-shaped form. The deep-drawing tool comprises a drawing bell and a drawing core, around which the drawing bell forms the pot-shaped moulded blank in a downward movement. As used here and in the following, the term "downward movement", is not intended to limit the invention to specific directions in space, but merely indicates a movement In the direction of a bottom dead centre of the drawing bell during the deep-drawing movement. In fact, this term coincides with a conventional arrangement in a deep-drawing machine, in which the drawing bell is lowered from above onto the drawing core. This movement of the drawing bell is usually controlled by a corresponding crank gear to ensure a sinusoidal movement of the drawing bell.

To prevent folds from forming at the edge of the moulded blank due to material compression, a so-called blank holder is provided which is pressed against the drawing bell from below in such a way that the edge portion of the blank rests between the drawing bell and the blank holder, and is clamped there. This clamping leads in turn to the problem that so-called paint hair forms on the flangeless moulded blank, i.e. hair-like structures which may contaminate the tool.

Various approaches aimed at reducing the formation of such paint hair exist. EP 2 125 264 B1, for example, shows a deep-drawing tool in which the blank holder is pressed in the direction of the drawing bell by the reaction force of a pneumatic spring. This spring acting on the blank holder, also referred to as a "drawing cushion" in the technical jargon, is formed here by a gas volume inside a chamber which is sealed by a piston that abuts against the blank holder by means of force transmission elements. During the deep-drawing process, the piston at first moves down together with the drawing bell. Once the piston reaches a pre-defined bottom position, the chamber is suddenly vented and thus the reaction force of the pneumatic spring Is set to zero. This cancels the clamping of the edge of the moulded blank. This prevents paint or film material from detaching from the sheet metal of the moulded blank and forming the undesirable paint hair as described above.

The design effort involved in the solution presented in EP 2 125 264 B1 is considerable. At every moulding cycle, the pneumatic cushions inside the chamber have to be refilled with high pressure after each venting operation. The consumption of compressed air is considerable, and hence so is the cost of generating the compressed air. Another drawback is the high level of noise at the time of venting the chamber, with the pressurised air escaping from the chamber with a bang. The sound damping systems required for compliance with occupational health and safety legislation generate further costs. In addition, the solution presented In EP 2 125 264 B1 is limited to the use of pneumatic cushions because this is the only type of cushion in which the spring force can be reset to zero by sudden venting. Nevertheless, mechanical drawing cushions are frequently also used in practice, where there Is a pre-tensioned mechanical compression spring between a fixed base plate and a mobile pressure plate. The mobile pressure plate is in contact with the blank holder via force transmission elements in the same way as the piston of the pneumatic cushion.

SUMMARY OF THE INVENTION

Hence it is a task of the present invention to provide a deep-drawing tool of the aforementioned type, offering an alternative means of inhibiting the formation of paint hair at the deep-drawing tool, which is connected with low effort, reduced cost, reduced noise and can also be used for mechanical drawing cushions.

This task is solved according to the invention by a deep-drawing tool with the features of the claims, and a corresponding deep-drawing method according to the claims.

The deep-drawing tool of the invention comprises a drive which, when the drawing bell has reached a predetermined position in its downward movement, drives the force transmission means which transmit the spring force of the drawing cushion to the blank holder to perform a movement preceding a further movement of the drawing bell. For the sake of linguistic simplicity, the position in which this further movement is triggered shall be referred to below as the "predetermined position".

This preceding movement removes the blank holder from the drawing bell, and the clamping effect of the blank holder is cancelled. This releases the edge of the moulded blank, thereby inhibiting the formation of paint hair. The preceding movement preferably starts just before completion of the deep-drawing movement of the drawing bell, or just before the clamped flange (edge area) of the blank enters the drawing radius of the bell and is elongated. The drive used to generate the preceding movement must be capable of producing sufficient force to overcome the spring force of the drawing cushion.

Because, in the deep-drawing tool according to the invention, the cushion spring force does not have to be reset to zero to release the edge of the moulded blank, considerable costs can be avoided for compressed air generation and noise damping, and there is no longer any limitation to pneumatic drawing cushions.

There are various ways of producing this preceding movement, and a number of preferred variants are presented in the sub-claims. This presentation should not be understood as exhaustive.

According to one embodiment of the present invention, the force transmission means comprise a piston or a pressure plate driven by the spring force in the direction of the drawing bell, whilst a pull rod driven by the drive is mounted on the piston or pressure plate.

The piston is preferably lodged in a chamber and seals a gas volume inside the chamber to form a pneumatic spring. In this case, the pneumatic spring forms the drawing cushion.

According to a further embodiment, the pressure plate is driven by a mechanical spring in the direction of the drawing bell. In this case, the drawing cushion is formed by the mechanical spring.

Further preferably, the drive includes a coupling rod positioned parallel to the pull rod or in its axial extension, and, in order to transmit a pulling movement from the coupling rod to the pull rod, engages with the pull rod no later than when the drawing bell reaches its predetermined position. Before the drawing bell reaches its predetermined position, the coupling rod can move freely relative to the pull rod, i.e. there Is no movement coupling, whereas once the drawing bell reaches its predetermined position, the coupling rod engages with the pull rod and pulls the latter downward with it. The coupling between coupling rod and pull rod may be provided by, for example, a coupling sleeve which is fixedly connected to the coupling rod and runs freely on the pull rod up to a stop which determines the engaged position. At the predetermined position the sleeve abuts against a stop and pulls the pull rod downward with it. The coupling between piston rod and pull rod may also be provided by other means.

According to another preferred embodiment, the drive comprises a cam track and a cam roller which rests on the cam track and is coupled for movement with the force transmission means. Thus, the cam roller can follow the course of the cam track. The shape of the cam track is chosen so that a downward movement of the cam roller Is only transmitted to the force transmission means once the drawing bell has reached the predetermined position in which the preceding movement is supposed to start. The cam track may be formed by various suitable mechanical elements such as, for example, a rotatable cam disk on whose circumference the curved track is formed, or by a translationally movable cam rod with the cam track on a lateral surface.

According to another preferred embodiment, the drive comprises a rotating eccentric connected to the force transmission means via a connecting rod assembly. This eccentric may be a crankshaft, for example, to which the end of a connecting rod is mounted. Apart from the connecting rod itself, there may also be other bars, levers or such like in the connecting rod assembly in order to achieve the desired movement coupling.

According to a further preferred embodiment of the present invention, the drive Includes a camshaft with the cam being arranged to push the force transmission means downward as the camshaft rotates.

Further preferably, the drive comprises a cam rod with a lateral curved profile on which a cam roller rests, which is mounted such that it can be pivoted around a pivot axis offset relative to the cam roller axis, and means for converting an oscillating movement of the cam roller around the pivot axis into a translation movement of the force transmission means. In this case, a translational movement of the cam rod and pivot axis relative to each other triggers pivoting of the cam roller, which is in turn translated into linear movement of the force transmission means.

According to another embodiment of the present invention, the drive of the force transmission means is coupled for movement with the drive of the drawing bell. This Is the simplest and most cost-effective means of synchronising the preceding movement relative to the drawing bell. For large moving masses, such motion coupling is energetically less expensive than providing an independent drive. The coupling may be performed rotationally by the press main shaft using suitable chain, belt or gear transmissions, or translationally by means of suitable coupling with the press ram, the upper tool or the drawing bell.

According to another embodiment of the present invention, the drive comprises an electromagnetic drive for moving the force transmission means.

In this case, according to other preferred embodiments, the drive comprises a coil and a plunger which dips into the coil, or a linear motor whose rotor is coupled with the force transmission means.

A method for deep drawing blanks according to the invention is claimed in the claims.

BRIEF DESCRIPTION OF THE DRAWINGS

Preferred embodiments of this invention will be described in more detail below with reference to the attached drawings, in which.

DETAILED DESCRIPTION

Figure 1C:
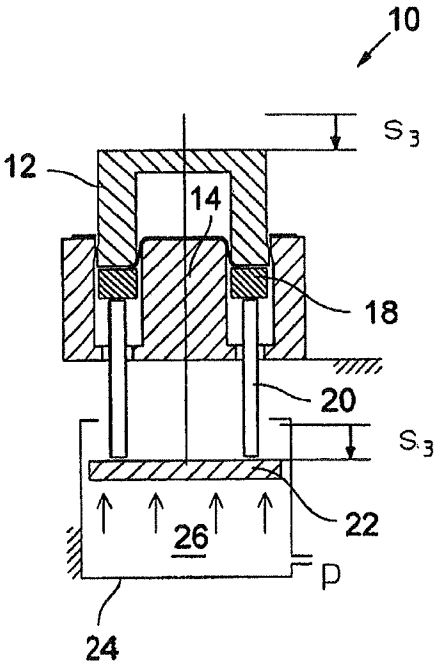
FIGS. 1*a* to 1*d* show a movement sequence of a schematically illustrated embodiment of the deep-drawing tool according to the present invention.
Figure 1B:
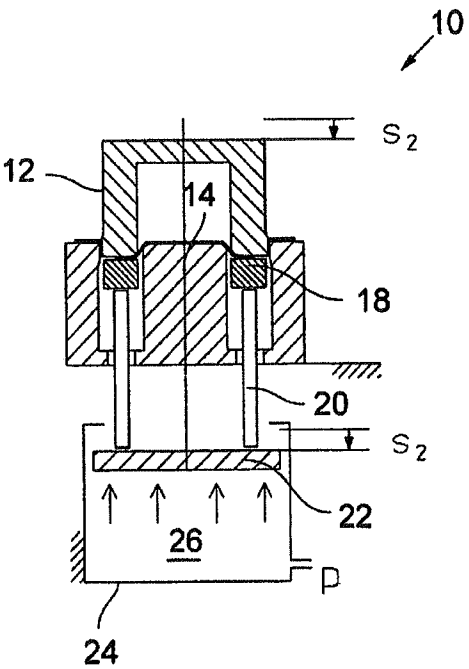
Figure 1A:
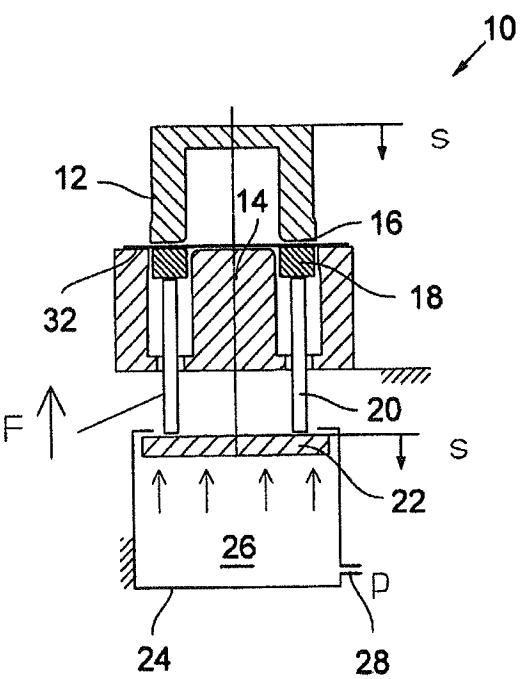

FIGS. 1*a* to 1*c* show a deep-drawing tool for deep drawing blanks punched out of sheet metal that is painted or coated with film material. The deep-drawing tool is designated in general by reference numeral 10 and comprises a drawing bell 12 shown in cross-section and a drawing core 14, over which drawing bell 12 is pulled downward in direction S during the deep-drawing process. This direction S designates a downward movement to a bottom dead centre of the drawing bell, which can be moved by a crank mechanism not shown in further detail and typically, although not limitatively, can perform a sinusoidal up and down movement, whilst drawing core 14 remains stationary.

Below edges 16 of drawing bell 12 there is a blank holder 18 disposed around drawing core 14 which can be moved up and down. Blank holder 18 rests on blank holder pins 20, which are in turn coupled at their bottom ends with a piston 22, which moves up and down inside a chamber 24. Below piston 22, inside chamber 24, there is a gas volume 26, sealed at its top end by piston 22. If piston 22 is lowered, the gas volume 26 inside chamber 24 is reduced and the gas is compressed. Additionally, the gas pressure p may also be controlled independently of the chamber volume via the gas inlet 28 to the gas chamber. The gas volume 26 therefore forms a pneumatic spring which exerts an upward spring force F (see arrow pointing upward In FIG. 1*a*) on blank holder 18 via blank holder pins 20 as force transmission elements. This spring will be referred to below as the drawing cushion. If drawing bell 12 is moved downward, this spring force F causes blank holder 18 to be pushed from below against edge 16 of drawing bell 12.

Figure 1D:
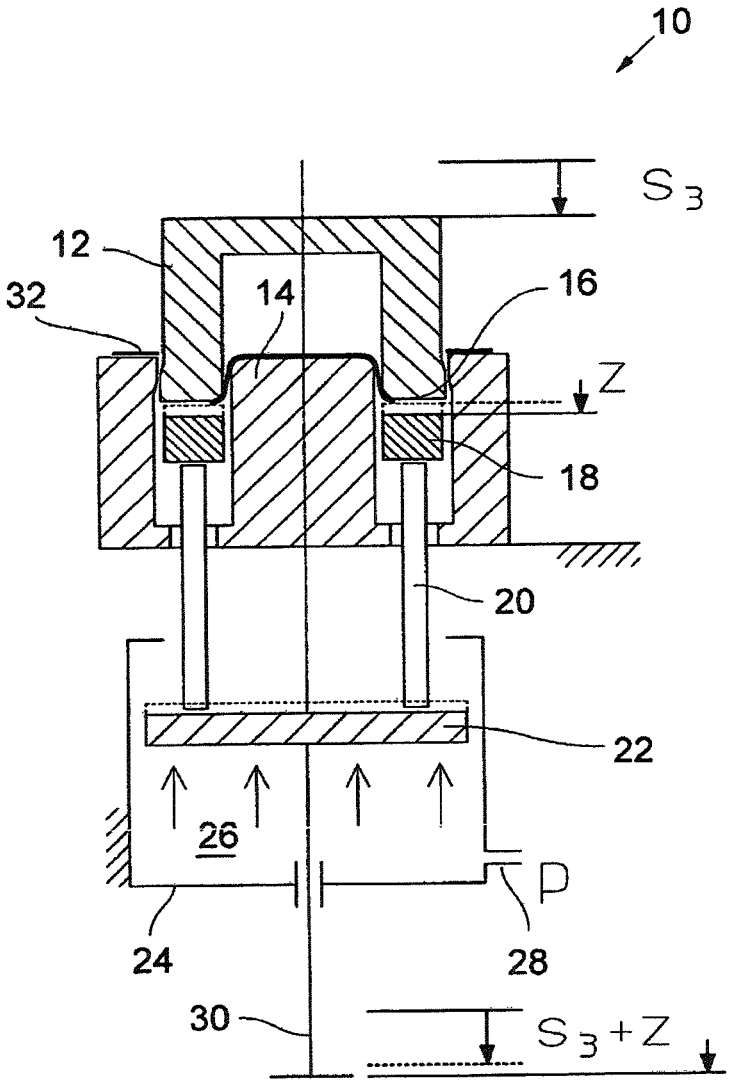

The above-described elements of deep-drawing tool 10 and its mode of functioning are essentially disclosed in EP 2 125 264 B1. To that extent, the illustrations in FIGS. 1*a* to 1*c* correspond to the state of the art. Not shown in FIGS. 1*a* to 1*c*, however, is a piston rod 30 connected to the underside of piston 22, which is schematically illustrated in FIG. 1*d*, and whose mode of functioning will be described below. It moves together with piston 22 in a vertical direction.

The terms "piston rod" and "piston" are designated here and in the following according to their use in connection with the pneumatic spring or pneumatic cushion. A mechanical spring may also be used instead of a pneumatic spring. In that case, the force transmission means for transmitting the spring force of the cushion to blank holder 18 comprise, instead of piston 22, a pressure plate which is supported from below by the mechanical springs. Generally speaking, piston rod 30 is merely an embodiment of a pull rod mounted on piston 22 or the pressure plate.

FIG. 1*a* shows drawing bell 12 in a position just before being placed on a disk-shaped blank 32 which rests on top of drawing core 14. For the purpose of deep drawing, drawing bell 12 moves downward in direction S, as a result of which its edge 16 draws the corresponding sections of blank 32 underneath downward over drawing core 14 as shown in the sequence of movements in FIGS. 1*b* and 1*c*. The path travelled by drawing bell 12 is designated by $S_2$ and $S_3$ respectively. During this movement, piston 22 travels along the same path $S_2$ or $S_3$ and is pressed downward against the spring force F of the cushion. The edge portion of the blank, which is successively deep-drawn into a moulded blank, is clamped between the lower edge 16 of drawing bell 12 and blank holder 18 during this movement.

Once a predetermined position of drawing bell 12 is reached during its downward movement, as shown in FIG. 1*d*, piston rod 30 is driven to perform a downward movement preceding the movement of drawing bell 12. Hence piston rod 30 moves downward faster than drawing bell 12, creating a gap Z and cancelling the clamping between blank holder 18 and the edge 16 of drawing bell 12. The gap between blank holder 18 and the edge 16 of drawing bell 12 is now greater than the material thickness of blank 32 and hence its edge area is released. The distance travelled by piston rod 30 and piston 22 together may, as shown in FIG. 1*d*, equal $S_3$+Z, i.e. be greater than the path, designated as S3, travelled by the drawing bell until it reaches the predetermined position at which the edge of blank 32 is released. In the context of this invention, it Is possible that drawing bell 12 continues downward beyond the position shown in FIG. 1*d* by a distance greater than $S_3$ in order to ensure completely flangeless elongation of the blank. In this case piston rod 30 with piston 22 is also moved further downward in synchronous or preceding fashion so that the size of gap Z is at least maintained or enlarged until the clamped flange (edge) of the blank comes within the drawing radius of the drawing bell, i.e. has passed surface 16 of the drawing bell. From this point, the piston rod with the piston can also be moved in lagging fashion or may be uncoupled from the piston drive, which would cause a reduction in the gap, or, in case of uncoupling, to the blank holder coming to rest against the surface of edge 16 of the drawing bell due to the cushion spring force.

Figure 1E:
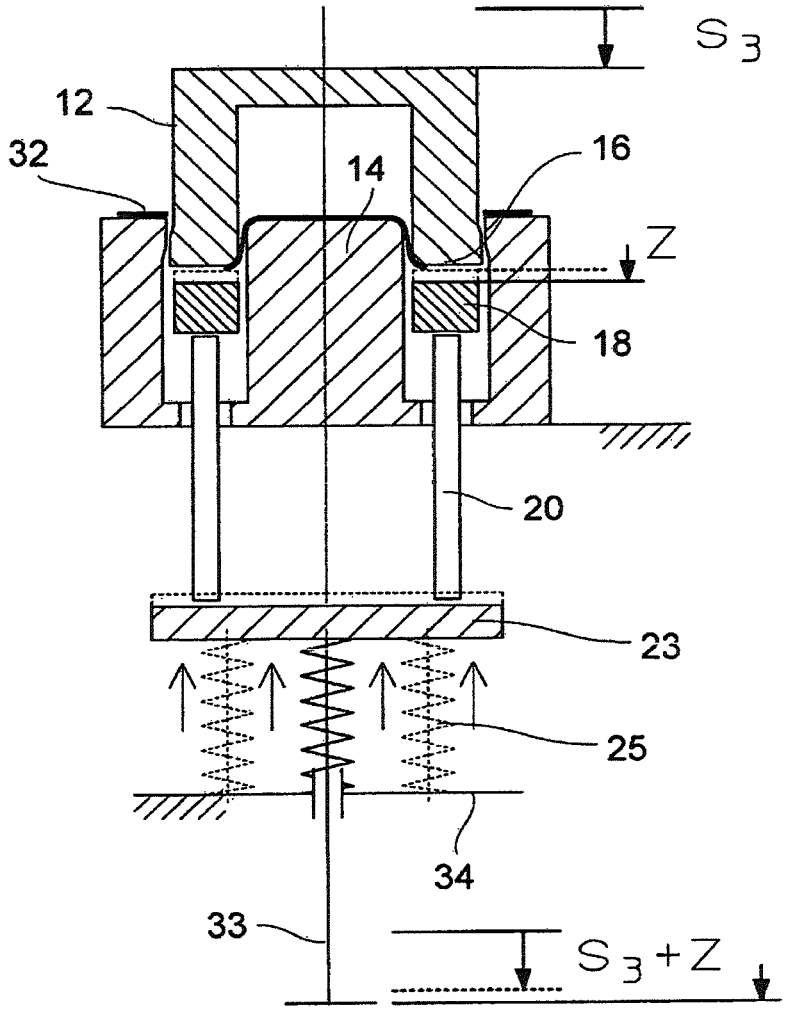
FIG. 1*e* shows an embodiment of the deep-drawing tool according to the present invention, with a mechanical drawing cushion.

FIG. 1*e* shows an alternative embodiment with a mechanical spring cushion wherein a pull rod 33 fixed to pressure plate 23 passes through the fixed base plate 34 on which at least one mechanical pressure spring 25 is disposed and pushes against pressure plate 23. In this case, pressure plate 23 replaces piston 22 and pull rod 33 replaces piston rod 30 of FIGS. 1*a* to 1*d*.

The embodiments of the present invention described below essentially relate to arrangements of a drive for the force transmission means to perform a movement preceding the movement of drawing bell 12, i.e. in this case, of the piston drive for moving piston rod 30 and piston 22 attached to it, which is not shown in the previous FIGS. 1*a* to 1*e*. The details shown there of drawing bell 12, drawing core 14 and blank holder 18 etc. are omitted in the following Figures for the sake of simplicity. The same elements are designated with the same reference numerals. It may be assumed that drawing bell 12, drawing core 14, blank holder 18 and blank holder pins 20 are contrived in the following embodiments as shown in FIGS. 1*a* to 1*d*, i.e. relative to a pneumatic cushion. It Is understood that the drives shown are also suitable for driving a pressure plate 23 via pull rod 33 according to FIG. 1*e*.

Figure 2:
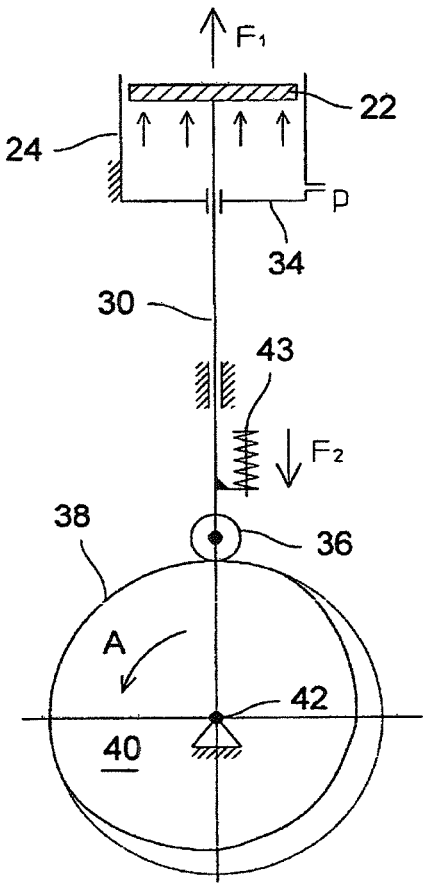
FIGS. 2 and 3 are partial schematic illustrations of a second and third embodiment of a deep-drawing tool according to the present Invention.

The upper portion of FIG. 2 shows chamber 24 with gas volume 26 (shown in FIGS. 1*a*-1*d* only) and piston 22 which can be moved inside the chamber. Piston rod 30 passes vertically through the bottom 34 of chamber 24 up to the underside of piston 22 and is attached to the latter so that a pulling force acting downward on piston rod 30 moves piston 22 downward.

Mounted on the other end of the piston rod there is a cam roller 36 which can be rotated around an axis perpendicular to piston rod 30. Cam roller 36 rests on the surface of a cam track 38 formed by the outside of a cam disk 40 which, in turn, can be rotated around an axis 42 parallel to the axis of rotation of cam roller 36. By means of a spring 43, piston rod 30 with cam roller 36 is pushed downward against cam track 38. Cam track 38 Is contrived so that, in one circumferential section of cam disk 40 (in particular the top left quadrant In FIG. 2), it runs around axis of rotation 42 of cam disk 40 in a circular shape, but, in the other three quadrants of the circumference of cam disk 40, approaches the latter's axis of rotation 42. If cam disk 40 is rotated around its axis of rotation 42 as indicated by arrow A in FIG. 2, in an anti-clockwise rotation, cam roller 36 can approach the axis of rotation 42 of cam disk 40 and yield to the pressure of spring 43 so that piston rod 30 is displaced downward. To this end, the downward pressure force F2 of spring 43 must be greater than the force F1 of the cushion, which counteracts the downward movement of piston 22.

Figure 3:
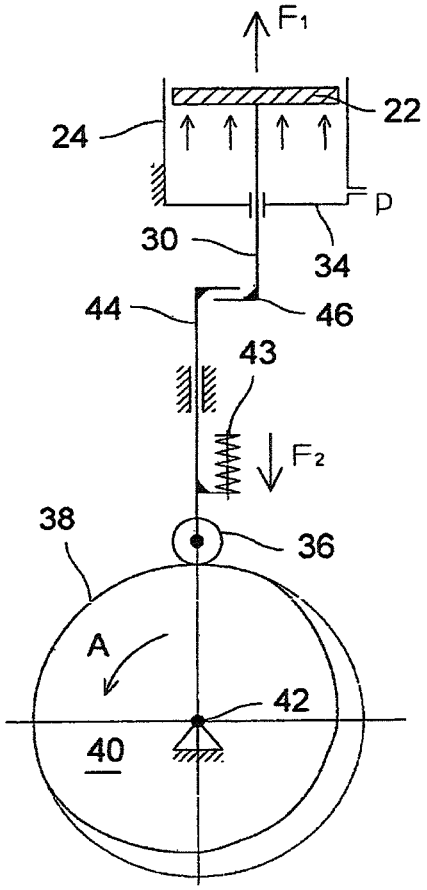

In the embodiment shown In FIG. 2, cam track 38 must be contrived so that the movements of cam roller 36 and drawing bell 12 are synchronised before drawing bell 12 reaches the predetermined position in which the edge portion of blank 32 Is to be released. To this end, cam disk 40 must be produced with a high degree of precision. In contrast, FIG. 3 shows an embodiment in which the up and down movement of cam roller 36 is not transmitted to piston rod 30 until the predetermined position of drawing bell 12 is reached.

This is achieved In that cam roller 36 is mounted on the bottom end of a coupling rod 44 which may be positioned parallel to piston rod 30, i.e. vertically, or in the latter's axial prolongation. Coupling rod 44 and piston rod 30 can be coupled together with suitable coupling means 46 such as a coupling sleeve running freely on piston rod 30, which is fixed to the upper end of coupling rod 44 such that coupling rod 44, during a downward movement, does not reach piston rod 30 before reaching a predetermined point (i.e when the sleeve runs up against a lower stop on piston rod 30) and then carries the latter with it In order to transmit a downward pulling movement of coupling rod 44 to piston rod 30. Above this stop point, where coupling takes place between coupling rod 44 and piston rod 30, coupling rod 44 runs freely and independently of any movement by piston rod 30.

This coupling mechanism 46 is used to pull piston rod 30 downward, but not until drawing bell 12 reaches its predetermined position, which corresponds to the desired preceding movement of piston rod 30 relative to drawing bell 12.

Figures 4A, 4B, 4C, 4D:
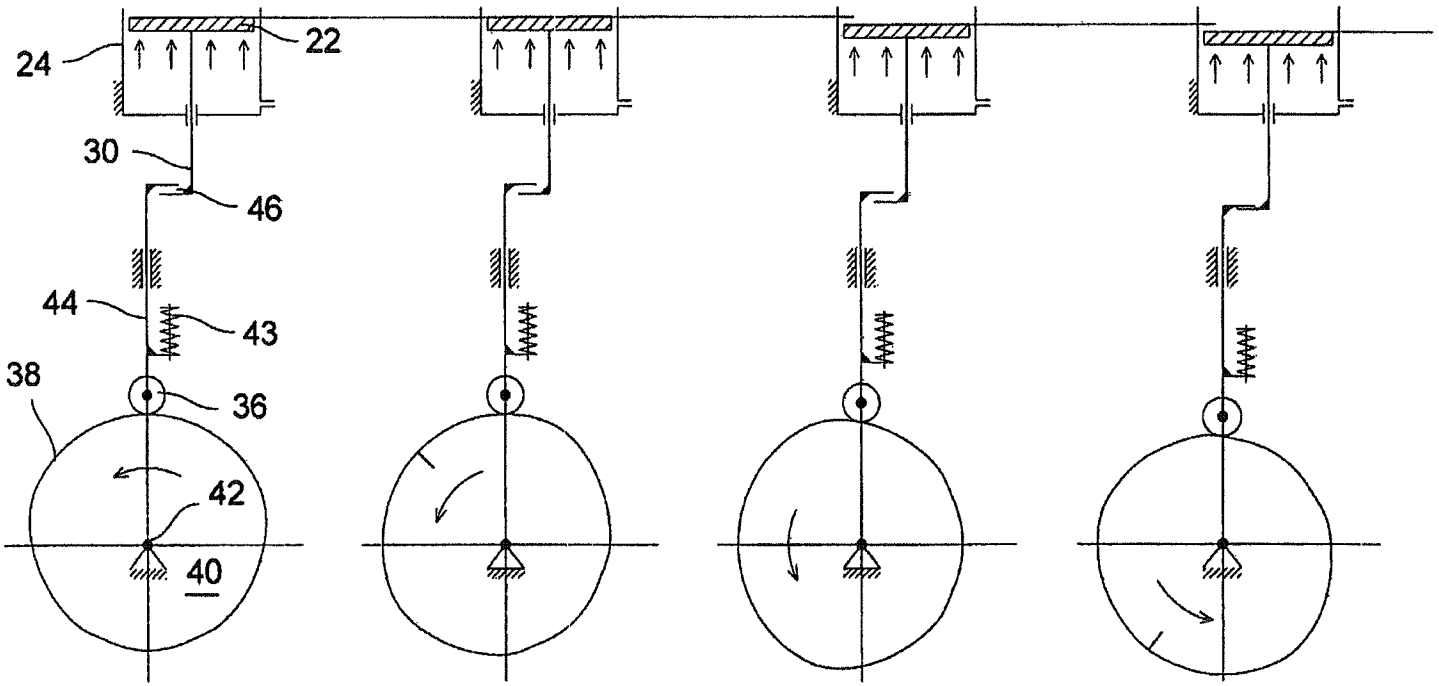
FIGS. 4*a* to 4*g* show a movement sequence of the third embodiment of the present Invention illustrated In FIG. 3.

Such a sequence of movements is illustrated in FIGS. 4*a* to 4*g*. FIG. 4*a* designates the top dead centre of drawing bell 12. In FIG. 4*b*, drawing bell 12 moves downward towards drawing core 14 until, in FIG. 4*c*, contact is made between drawing bell 12 and blank 32, and the punching and deep-drawing process starts. As this takes place, drawing bell 12 moves downward in sinusoidal fashion, together with piston 22 and piston rod 30, which is still uncoupled from coupling rod 44. Meanwhile, cam disk 40 performs a continuous rotation in the anti-clockwise direction.

During a further rotation of cam disk 40 from the position shown In FIG. 4*c* to FIG. 4*d*, cam roller 36 runs up against a portion of cam track 38 which continually moves closer to the axis of rotation 42 of cam disk 40. Due to the pressure of spring 43, it is pushed further downward and moves coupling rod 44 downward faster than drawing bell 12 so that coupling rod 44 engages with piston rod 30, taking it with it. This takes place at the defined position of drawing bell 12, where the edge of blank 32 is to be released.

Figures 4E, 4F, 4G:
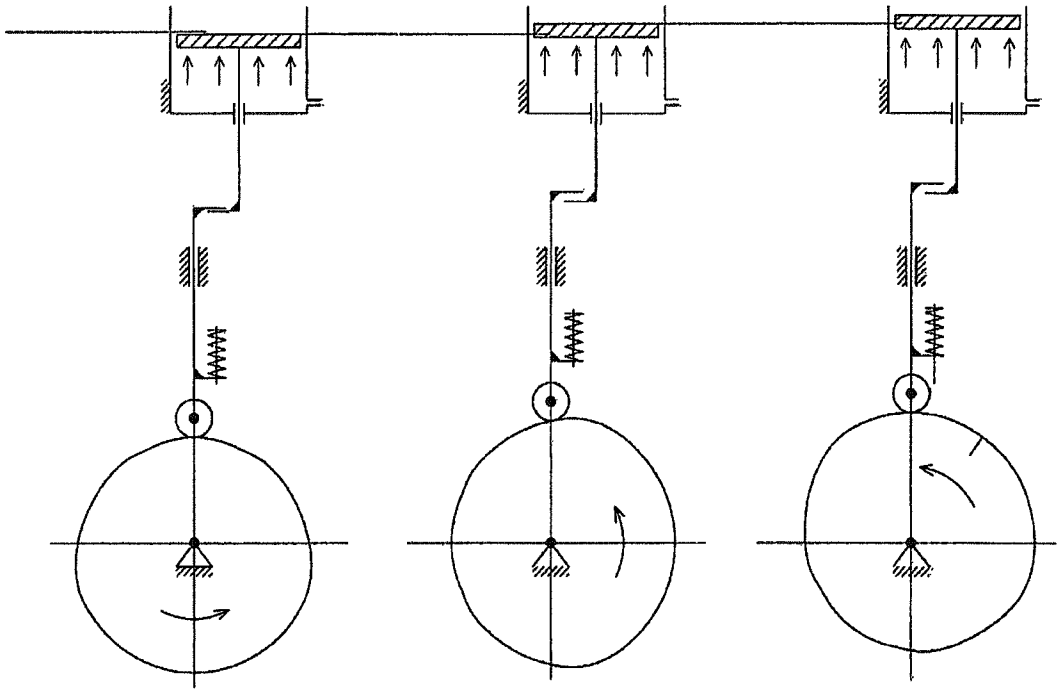

In FIG. 4*e*, the bottom dead centre of the movement of drawing bell 12 is reached. On the way from the position in FIG. 4*d* to FIG. 4*e*, the edge portion of the blank passes the surface 16 of the drawing bell and is elongated. As soon as there is no longer any danger of paint hair forming, shortly after the position in FIG. 4*d*, the size of the additional lift Z (see FIG. 1*d*) is no longer relevant and may either remain as it Is, change in size or be reduced to zero. FIG. 4*e* shows, by way of example, an unchanged additional lift with continued coupling between coupling rod 44 and piston rod 30.

In FIGS. 4*f* and 4*g*, the drawing bell moves upward again, which cancels the coupling between coupling rod 44 and piston rod 30.

Figure 5:
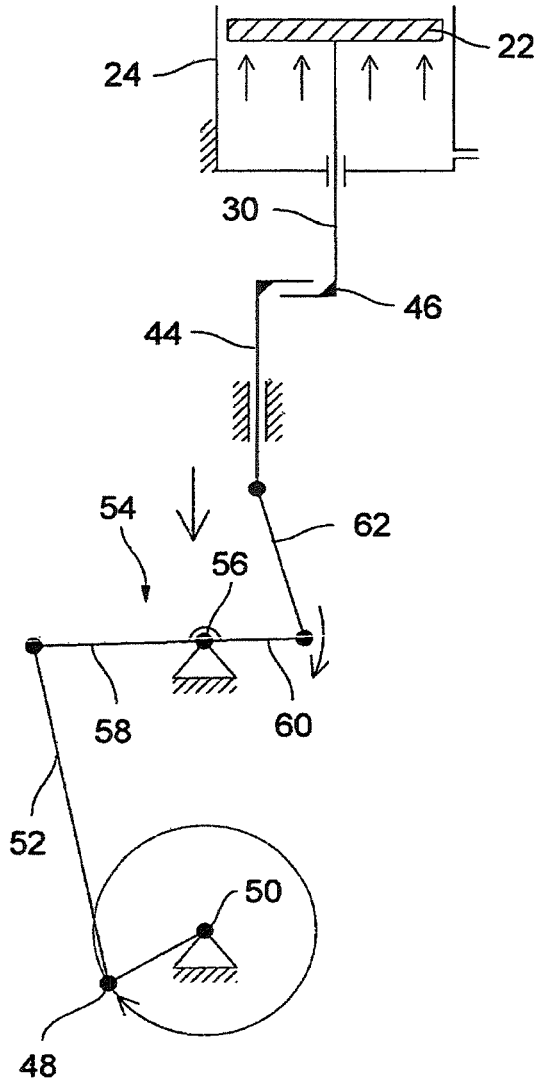
FIGS. 5 and 6 are partial schematic illustrations of a fourth and fifth embodiment of a deep-drawing tool according to the present invention.

In the embodiment of the deep-drawing device 10 shown in FIG. 5, the piston drive comprises a rotating eccentric 48, which may be a crankshaft which rotates around a rotation axis 50. Attached to eccentric 48 there is a bottom end of a connecting rod 52, whose top end is connected with a two-arm swing arm 54. This swing arm 54 swings around a pendulum axis 56 from which the two swing arms 58,60 extend in different directions. The first swing arm 58 is connected with the top end of connecting rod 52, whilst the second swing arm 60 positioned opposite in FIG. 5 is connected with the bottom end of a push rod 62 whose top end is connected to the bottom end of coupling rod 44.

With steady rotation of eccentric 48, this rotary movement is transformed into a sinusoidal oscillating movement of swing arm 54. By appropriate dimensioning of the lengths of swing arms 58,60 it is possible to have coupling rod 44 make a larger displacement in the vertical direction, thereby "catching up" with piston rod 30 on its way downward so that coupling rod 44 and piston rod 30 engage and coupling rod 44, with its higher speed, pulls piston rod 30 downward.

Figure 6:
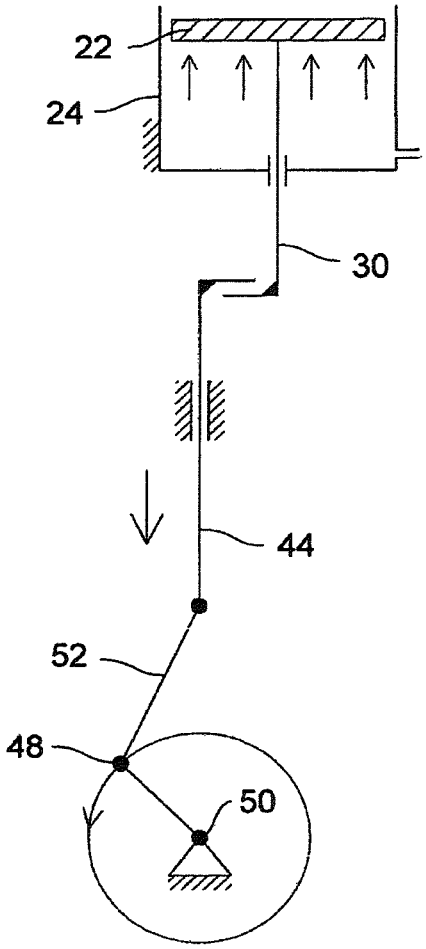

In the embodiment shown in FIG. 6, the top end of connecting rod 52, which is driven by eccentric 48, is directly connected to coupling rod 44. In this case, eccentric 48 is driven by an electric drive, a servomotor for example, whose speed is controlled so that, when drawing bell 12 reaches the predetermined position but not before, the desired additional lift in the preceding movement of piston rod 30 is generated by a correspondingly faster pulling movement of coupling rod 44 downward, which is brought into engagement with the bottom end of piston rod 30 at this moment.

Figure 7:
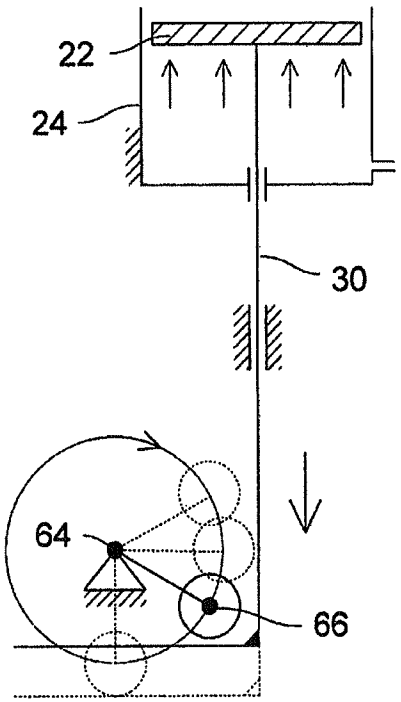

FIG. 7 shows another embodiment in which the piston drive comprises a camshaft 64 whose cam 66 is disposed so that, in a certain rotary position of camshaft 64, it engages with piston rod 30 or a projection provided on piston rod 30 so that piston rod 30 is pushed downward during the continued rotary movement of camshaft 64. Camshaft 64 may have a steady rotational speed and be coupled with the drive of the upper tool, or may have an independently controlled electric drive.

Figure 8:
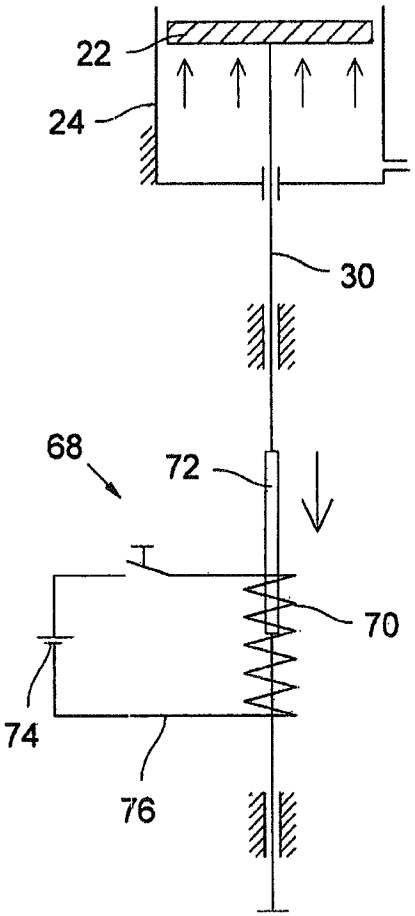

In the embodiment shown in FIG. 8, the piston drive comprises an electromagnetic drive 68 for moving piston rod 30. This electromagnetic drive 68 comprises a coil 70 and a plunger 72 which plunges into coil 70 and is connected to piston rod 30. Coil 70 is connected to a source of current 74 by means of a corresponding switching circuit 76 so that coil 70 can be periodically supplied with electricity. When the electricity is supplied, plunger 72 is pulled inside coil 70, thereby pulling piston rod 30 downward.

Figure 9:
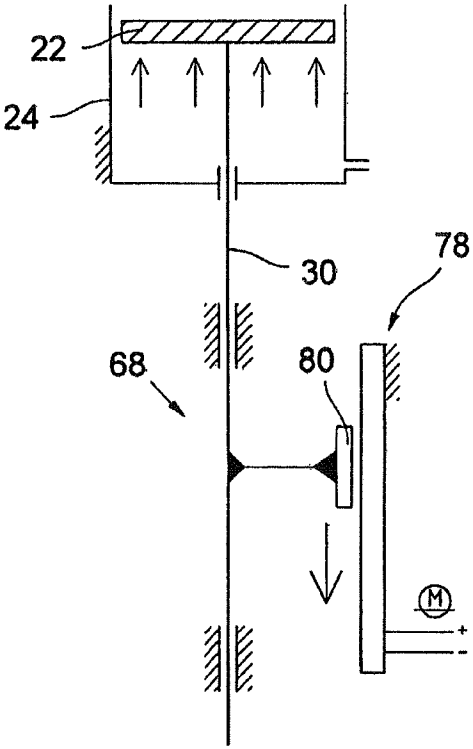
FIGS. 7 to 9 are schematic illustrations of a sixth, seventh and eight embodiment of a deep-drawing tool according to the present invention.

The electric drive 68 of the embodiment in FIG. 9 comprises a linear motor 78 with a rotor 80 which is coupled with piston rod 30. If rotor 80 is displaced downward, it pulls piston rod 30 with it in the same direction.

Figure 10:
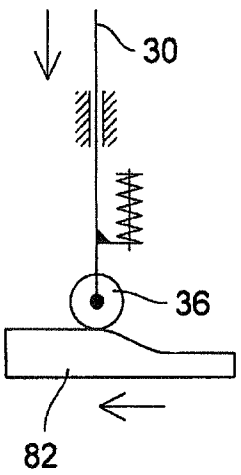

In the embodiment shown in FIG. 10, in a similar way to FIG. 2, a cam roller 36 is attached to the bottom end of piston rod 30 and, in this case, runs along the top surface of a translationally movable cam bar 82. The top surface of cam bar 82 forms a cam track and cam bar 82 is positioned horizontally, i.e. perpendicular to the vertical direction of movement of piston rod 30. During the to and fro movement of cam bar 82, the cam roller 36 is moved up and down and this movement is transmitted to piston rod 30.

Figure 11:
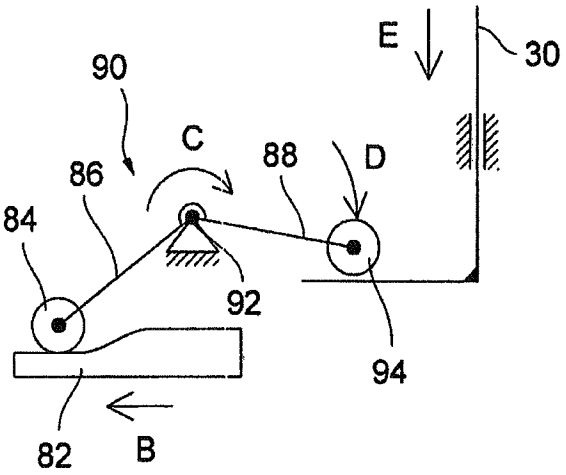

The embodiment in FIG. 11 comprises a swing arm 90 which swings around a pendulum axis 92 and has two arms 86, 88 which extend from pendulum axis 92 in different spatial directions. Attached to a first arm 86 there is a cam roller 84 which runs along the top surface of a cam bar 82 which is arranged in similar fashion as in the previous embodiment in FIG. 10, namely horizontally, and may be moved translationally to and fro. During this to and fro movement of cam bar 82, the cam roller 84 running on top of it is moved up and down.

Through this movement, swing arm 90 is swung around pendulum axis 92 so that a pressure roller 94 connected to the end of the other arm 88 also performs a swinging movement and, as a result, is essentially moved up and down. During its downward movement, pressure roller 94 engages with piston rod 30 by means of a stop provided for this purpose, for example, and pushes piston rod 30 downward. This downward pulling movement of piston rod 30 can be controlled by the shape of the cam track of the cam roller 84.

In FIG. 11, cam roller 84 Is shown in a bottom position on a lower section of the left end of cam bar 82. If cam bar 82 is moved from this position in horizontal direction towards the left (arrow B), in the middle section of cam bar 82, cam roller 84 runs up against a rising portion of the cam track and is therefore pushed upward. This causes swing arm 90 to pivot clockwise (arrow C). This then causes pressure roller 94 to pivot downward in clockwise direction (arrow D) and engages with piston rod 30 which is pushed downward (arrow E). This process can be reversed if cam bar 82 moves back in the opposite sense to direction B.

Figure 12:
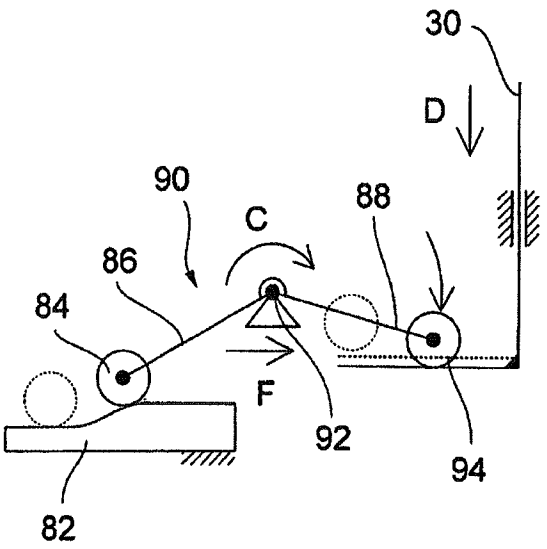
FIGS. 10 to 12 are schematic illustrations of the mode of functioning of a ninth, tenth and eleventh embodiment of a deep-drawing tool according to the present Invention.

FIG. 12 shows another embodiment in which cam bar 82 is fixed and, instead, pendulum axis 92 of swing arm 90 is moved translationally to and fro (arrow F). Here, too, cam roller 84 runs up against the rising portion of cam bar 82, which results in a pivoting movement of swing arm 90 and pushes the pressure roller 94 downward together with piston rod 30.

Differing from the presentation in FIGS. 11 and 12, the embodiments presented therein may be contrived so that pressure roller 94 does not engage directly with piston rod 30, but with a coupling rod 44, similar to the presentation in FIG. 3. This means that the downward pivoting movement of pressure roller 94 only translates into a downward movement of piston rod 30 at a certain point along its track at which the coupling between coupling rod 44 and piston rod 30 takes place. Further, alternative means for translating the pivoting movement of cam roller 84 generated by cam bar 82 into a translation movement of force transmission means 20,22 are conceivable.

The invention claimed is:

1. A deep-drawing tool for deep drawing blanks which are punched out of sheet material that is painted or coated with film material, in order to obtain flangeless molded blanks, comprising:

a drawing bell, a drawing core, a blank holder, a force transmission device, a drawing cushion for applying a spring force to the blank holder by the force transmission device, and a drive which, after the drawing bell reaches a predetermined position in downward movement thereof when the blank is in full contact with the upper surface of the drawing core, is configured to drive the force transmission device to perform a movement which precedes a further movement of the drawing bell to form an increasing distance between the drawing bell and the force transmission device while also continuing to move the drawing bell down in order to ensure completely flangeless elongation of the blank, wherein the drive comprises:

a cam bar, a cam roller having an axis and resting laterally on the cam bar, the cam roller being pivotably mounted around a pivot axis which is offset relative to the axis of the cam roller, and an arrangement for converting a pivoting movement of the cam roller around the pivot axis into a translation movement of the force transmission device.

2. A deep-drawing tool according to claim 1, wherein the force transmission device includes:

one of a piston and a pressure plate which is driven by the spring force in the direction of the drawing bell, and a pulling rod attached to the one of the piston and pressure plate, with the pulling rod being driven by the drive.

3. A deep-drawing tool according to claim 2, wherein the piston engages in a chamber and seals a gas volume inside the chamber, which forms a pneumatic spring as the drawing cushion.

4. A deep-drawing tool according to claim 1, wherein the drive of the force transmission device is coupled for movement with a drive of the drawing bell.

5. A deep-drawing tool for deep drawing blanks which are punched out of sheet material that is painted or coated with film material, in order to obtain flangeless molded blanks, comprising:

a drawing bell, a drawing core, a blank holder, a force transmission device, a drawing cushion for applying a spring force to the blank holder by the force transmission device, and a drive which, after the drawing bell reaches a predetermined position in downward movement thereof when the blank is in full contact with the upper surface of the drawing core, is configured to drive the force transmission device to perform a movement which precedes a further movement of the drawing bell to form an increasing distance between the drawing bell and the force transmission device while also continuing to move the drawing bell down in order to ensure completely flangeless elongation of the blank, wherein the drive comprises a cam track and a cam roller which runs along the cam track and is coupled for movement with the force transmission device.

6. A deep-drawing tool according to claim 5, wherein the force transmission device includes:

one of a piston and a pressure plate which is driven by the spring force in the direction of the drawing bell, and a pulling rod attached to the one of the piston and pressure plate, with the pulling rod being driven by the drive.

7. A deep-drawing tool according to claim 6, wherein the piston engages in a chamber and seals a gas volume inside the chamber, which forms a pneumatic spring as the drawing cushion.

8. A deep-drawing tool according to claim 5, wherein the drive of the force transmission device is coupled for movement with a drive of the drawing bell.

9. A method for deep drawing blanks which are punched from sheet metal that is painted or coated with film material, to obtain flangeless molded pieces, comprising the steps of:

shaping a blank by a drawing bell of a drawing tool around a drawing core to create a pot-shaped part with a flangeless cylindrical edge, during molding of an edge of the blanks, applying a spring force with the help of a blank holder to a side of the edge furthest from the drawing bell by a drawing cushion by a force transmission device, when the drawing bell reaches a predetermined position in downward movement thereof when the blank is in full contact with the upper surface of the drawing core, driving the force transmission device to perform a movement which precedes a further movement of the drawing bell to form an increasing distance between the drawing bell and the force transmission device while also continuing to move the drawing bell down in order to ensure completely flangeless elongation of the blank, wherein the step of driving includes the step of running a cam roller, which is coupled for movement with the force transmission device, along a cam track.

10. A method for deep drawing blanks which are punched from sheet metal that is painted or coated with film material, to obtain flangeless molded pieces, comprising the steps of:

shaping a blank by a drawing bell of a drawing tool around a drawing core to create a pot-shaped part with a flangeless cylindrical edge, during molding of an edge of the blanks, applying a spring force with the help of a blank holder to a side of the edge furthest from the drawing bell by a drawing cushion by a force transmission device, when the drawing bell reaches a predetermined position in downward movement thereof when the blank is in full contact with the upper surface of the drawing core, driving the force transmission device to perform a movement which precedes a further movement of the drawing bell to form an increasing distance between the drawing bell and the force transmission device while also continuing to move the drawing bell down in order to ensure completely flangeless elongation of the blank, wherein a cam roller is pivotally mounted around a pivot axis which is offset relative to an axis of a cam roller, and the cam roller laterally rests on a cam bar, and wherein the step of driving includes the step of converting a pivoting movement of the cam roller around the pivot axis into a translation movement of the force transmission device.

* * * * *